US005878673A

United States Patent [19]

Kramer et al.

[11] Patent Number: 5,878,673

[45] Date of Patent: Mar. 9, 1999

[54] CONNECTABLE/RELEASABLE COMPUTER FURNITURE AND THE LATCHING SYSTEM USED THEREON

[76] Inventors: Edward J. Kramer, 4029 13th W., Seattle, Wash. 98119; John Horning, 11221 Acrewood Dr., Cincinnati, Ohio 45249; Gregory R. Furnish, 2614 Top Hill Rd., Louisville, Ky. 40206; Paul Allen, 4 Emery La., Cincinnati, Ohio 45227

[21] Appl. No.: 991,741

[22] Filed: Dec. 16, 1997

[51] Int. Cl.[6] ..... A47B 35/00

[52] U.S. Cl. ..... 108/50.02; 108/64; 403/408.1

[58] Field of Search ..... 108/64, 50.07, 108/50.01; 317/223.6, 223.3, 195, 321; 403/408.1, 322, 405.1

[56] References Cited

U.S. PATENT DOCUMENTS

| | | | |
|---|---|---|---|
| 4,591,289 | 5/1986 | Vickers et al. | 108/64 X |
| 4,748,913 | 6/1988 | Favaretto et al. | 108/50.02 |
| 4,879,955 | 11/1989 | Moll et al. | 108/50.02 |
| 5,144,888 | 9/1992 | Heine et al. | 108/64 |
| 5,237,935 | 8/1993 | Newhouse et al. | 108/50.02 |
| 5,522,324 | 6/1996 | Van Gelder et al. | 108/50.02 |
| 5,606,920 | 3/1997 | Meyer et al. | 108/50.02 |
| 5,640,912 | 6/1997 | Diffrient | 312/223.6 X |
| 5,678,948 | 10/1997 | White | 108/64 X |

*Primary Examiner*—Jose V. Chen
*Attorney, Agent, or Firm*—Jensen & Puntigam, P.S.

[57] ABSTRACT

The system of computer furniture includes a plurality of conference units which have a work surface with a straight portion and a 90° curved portion at one end of the straight portion, a plurality of units having a straight work surface, a plurality of units having a quarter-round (90°) work surface, a plurality of units having a half-round (180°) work surface, and a plurality of units having one inside corner configuration. The units each include a first latch member on one end thereof and a second latch member on the other end thereof so that the units can be conveniently mated with and released from each other to provide flexibility in making various system arrangements. The latch member itself comprises two mating portions, one portion having a body and two truncated triangular elements extending from a surface of the body, with a space therebetween, the other portion having a body with two triangular slots therein to receive the triangular elements of one portion. The one portion includes a locking element member which moves between two positions to latch and then release the two portions.

18 Claims, 8 Drawing Sheets

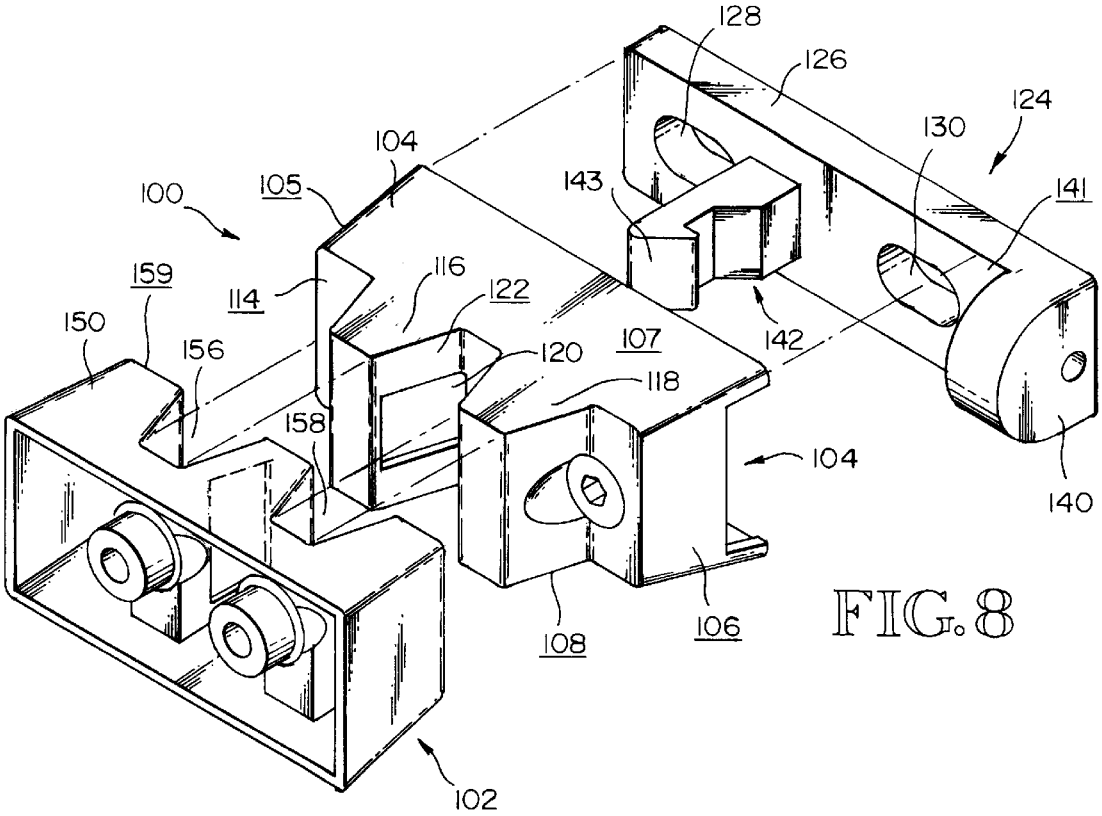
FIG. 8
FIG. 9
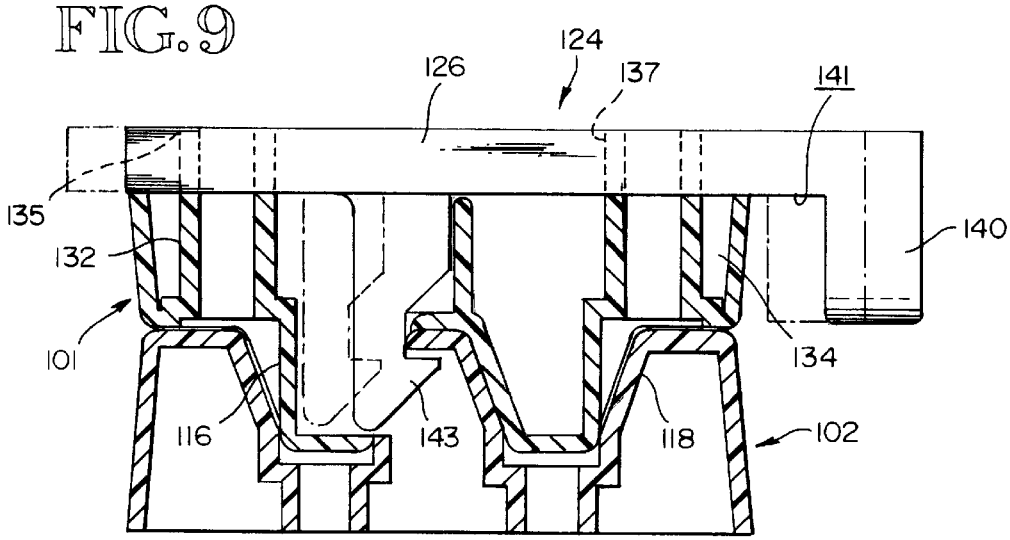

CONNECTABLE/RELEASABLE COMPUTER FURNITURE AND THE LATCHING SYSTEM USED THEREON

TECHNICAL FIELD

This invention relates generally to computer furniture/work stations and more particularly concerns a system of computer furniture configurations which includes latching/connecting means so that different arrangements of the various furniture configurations may be easily made.

BACKGROUND OF THE INVENTION

With the widespread advent of computers, particularly in classroom instruction situations involving a large number of computers, computer furniture/work stations have been the focus of a significant amount of design effort. Besides providing appropriate work surfaces for the users, it is important to design the furniture units to specifically accommodate individual computers and related equipment. Typically, the furniture units are designed specifically for computers, as well as printers and other peripheral equipment, with appropriate accompanying work spaces. Side panels, back panels and drawer pedestals are also usually part of such designs.

Typically, such furniture units are designed to be stand-alone, but also usually can be used together in different system arrangements, depending on the needs of the users or the design of a particular computer lab. Often, however, once a particular computer lab installation is made, involving a particular arrangement of various computer furniture units, it is difficult and time-consuming to change the arrangement to a different system configuration. Also, due to the design of the individual units, the possible system arrangements are usually quite limited. A typical installation might thus include rows or lines of stations, which is suitable for one particular type of instruction. Such an arrangement is often not satisfactory, however, in other types of instructional situations, nor does it provide for group/collaborative learning. In addition, an instructor may, for various reasons, wish to reconfigure a particular arrangement, such as changing from a "row" to a "cluster" configuration. Different teachers may also want different arrangements. Existing systems do not permit such ready flexibility.

Thus, there is a continuing need for a system of computer furniture which is configured, constructed and designed so that units of different configuration, which serve different specific needs, can be conveniently grouped or arranged, and then regrouped, into a variety of different system configurations, depending upon the particular needs of the actual users at a particular time.

DISCLOSURE OF THE INVENTION

Accordingly, the invention includes a system of computer furniture, comprising: a plurality of curved furniture units having two ends at approximately 90° to each other, the curved furniture units having a work surface which includes a raceway for electrical cords along a rear edge thereof, wherein the curved units include a first latch member at one end of the unit and a second latch member at the other end thereof; and a plurality of linear furniture units having a straight work surface with two ends, including a raceway for electrical cords at a rear edge thereof, wherein the linear units include a first latch member at one end of the unit and a second latch member at the other end; wherein a first latch member on any of said curved and linear furniture units fits snugly into a second latch member on any other furniture unit to produce a fixed, latched connection between said first and second latch members and the furniture units on which they are located wherein the first and second latch members are located on the furniture units in such a manner that when said furniture units are connected together, the raceways in the units line up with each other, forming a continuous raceway for the system.

The invention further includes a latching system for connecting adjacent furniture units, comprising: a first latch member which is positionable on one furniture unit, the first latch member including a body portion and two tapered, spaced elements which extend away from one surface of the body portion, the first latch member including a locking element which is movable between a retracted position and a latching position; and a second latch member positionable on adjacent furniture, the second latch member including a body portion having two tapered slots therein which receivably mate with the tapered portions of the first latch members so that when the first and second tapered elements mate with the tapered slots, said one surface of the first latch member comes adjacent to a corresponding surface of the second latch member, wherein the second latch member includes a cutout portion for receiving a hook portion of said locking element when the locking element is in its latching position, resulting in the two latch members and the adjacent furniture units being securely connected together.

BRIEF DESCRIPTION OF THE DRAWINGS

FIG. 8 is an exploded view of the connector system of the present invention.

FIG. 9 is a partial cross-sectional view of the connector of FIG. 8.

BEST MODE FOR CARRYING OUT THE INVENTION

Figure 1:
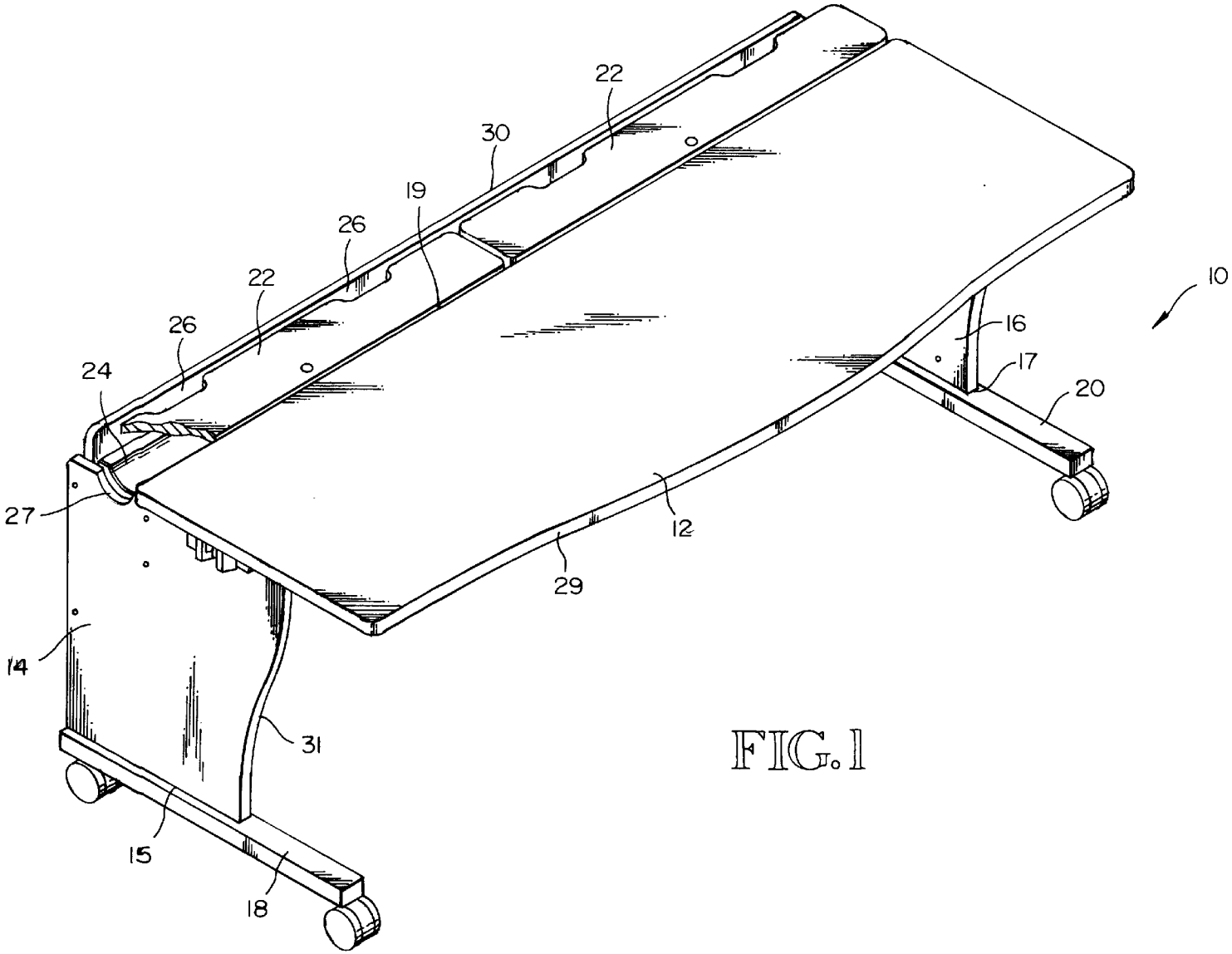
FIG. 1 is a perspective view of one furniture unit of the present invention.

The present invention is a system of computer furniture which includes several different units having different work surface configurations, each unit capable of stand-alone operation, in combination with an easy connect/release latching system located on each unit, so that the individual units can be readily connected and disconnected into and from a variety of system arrangements. The furniture units are all designed to have raceways along a rear edge thereof so that a continuous raceway will exist through the entire system, regardless of the particular arrangement of the various units. The raceways provide for convenient routing of the electrical and data cords for the individual computers, printers and related equipment in the individual work stations.

The following portion of the description is directed toward the various individual units which form the system of the present invention. The first unit 10, shown in FIG. 1, has a linear/rectangular work surface 12. The linear units can be of various lengths. Typically, the linear units will be 30" deep (although other depths are possible), with the lengths ranging from 24" for a printer station to 36", 60" and 72". Other lengths can, of course, be used. Each linear work station will include two vertical end members 14 and 16 which terminate at the lower edges 15 and 17 in horizontal elongated foot members 18 and 20. Foot members 18, 20 can rest directly on the floor or on casters, as shown. At the rear edge of the work surface 12 are raceway covers 22. Raceway covers 22 are rotatably connected to the rear edge 19 of work surface 12 so that they can be conveniently rotated upwardly, revealing raceway support member 24, which is typically positioned a few inches below raceway covers 22 and extends for the entire length of the unit.

Cutout portions 26 are typically provided in the rear edge of raceway covers 22 to permit ease of rotation of the covers 22. The upper edge of the end members also include a cutout portion 27, to permit electrical and data cords to extend into the raceway of each unit while the raceway cover remains flat. The raceways thus become in effect continuous from unit to unit. When covers 22 are lifted upwardly, the entire raceway is revealed. This is very convenient for system users and designers. Linear unit 10 also includes a back member 30 which extends between and is secured to the rear edges of the two end members 14 and 16. The back member typically extends approximately 18 inches down from the work surface.

The front edge 29 of the linear member 10 can be curved, as shown, to approximate a wave, although such configuration is not necessary for the system of the present invention. The "wave" edge gradually curves outwardly from the ends of the linear surface to a point midlength of the work surface, where the depth of the work surface is greatest. The advantage of this "wave" front edge is that it directs several students at the station toward the one computer at the station. The front edge 31 of the end members can also be curved in a similar wave-like configuration.

The second unit is referred to as a curved unit, in this case a conference unit, shown generally at 36. In a curved unit, one end is at 90° to the other end. The curved unit can include a straight portion. The conference unit in the embodiment shown has a depth of 30", like the linear units. The conference unit 36 includes a work surface 37 which has a linear portion 39 approximately 66" long and a 90° curved portion 41 which has a radius of approximately 30". The conference unit may be either right-hand or left-hand, i.e. curving in one direction or the other. Placing a right-hand and a left-hand unit together back-to-back will produce a 180° curved end portion with a total depth of 60 ".

In the embodiment shown, the conference unit includes a raceway 38 which extends from square end 40, over the linear portion 39 of the unit. The raceway 38 is configured similar to that explained above with respect to the linear unit 10. The conference unit includes an end member 42 at square end 40 thereof, an end member 46 which extends along straight edge 48 of the curved portion, and an end member 49 which is positioned at the dividing point between the linear and curved portions, parallel with end member 42. The three end members 42, 46 and 49 are supported on associated feet which rest on the floor or with casters. The end members may have a curved front edge like that of the linear unit. The conference unit also includes a flat back member which extends from end member 42 to end member 49 and is secured thereto.

A plurality of conference units, either right-hand or left-hand or a combination of both, with a plurality of linear units permits a number of different system arrangements. Various clusters can be produced, with different combinations of the units, providing a myriad of different work spaces, to meet various needs. Additional furniture unit configurations described above increase the possible combinations. Each unit is designed to mate with every other unit, to provide continuous work surfaces and raceways.

Figure 3:
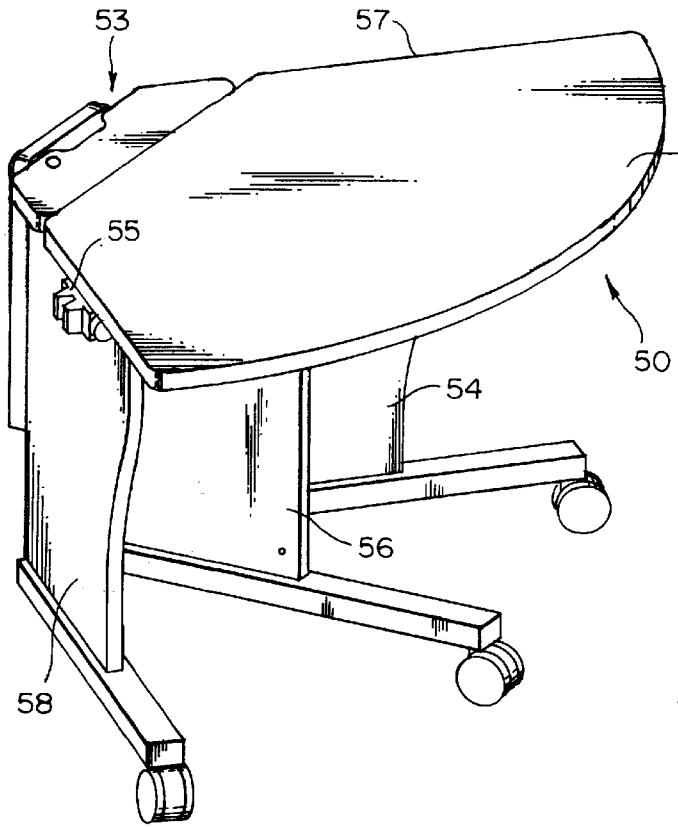
FIG. 3 is a perspective view of a third furniture unit of the present invention.

A third unit is shown at 50 in FIG. 3. This is a particular form of curved unit without any linear surface. It includes a quarter-round (or oval) work surface 52 and includes a raceway and cover 53 at the intersecting corner thereof. Work surface 52 in the embodiment shown includes straight edges 55 and 57 of 30". Curved edge 59 joins the two straight edges. Quarter-round unit 50 has three end members 54, 56 and 58, similar to those for the other units, each end member being secured to a horizontal leg which can either rest directly on the floor or on casters. End members 54, 59 are located at the two straight edges 55 and 57 of the unit, with the other end member being positioned midway angularly therebetween.

Figure 4:
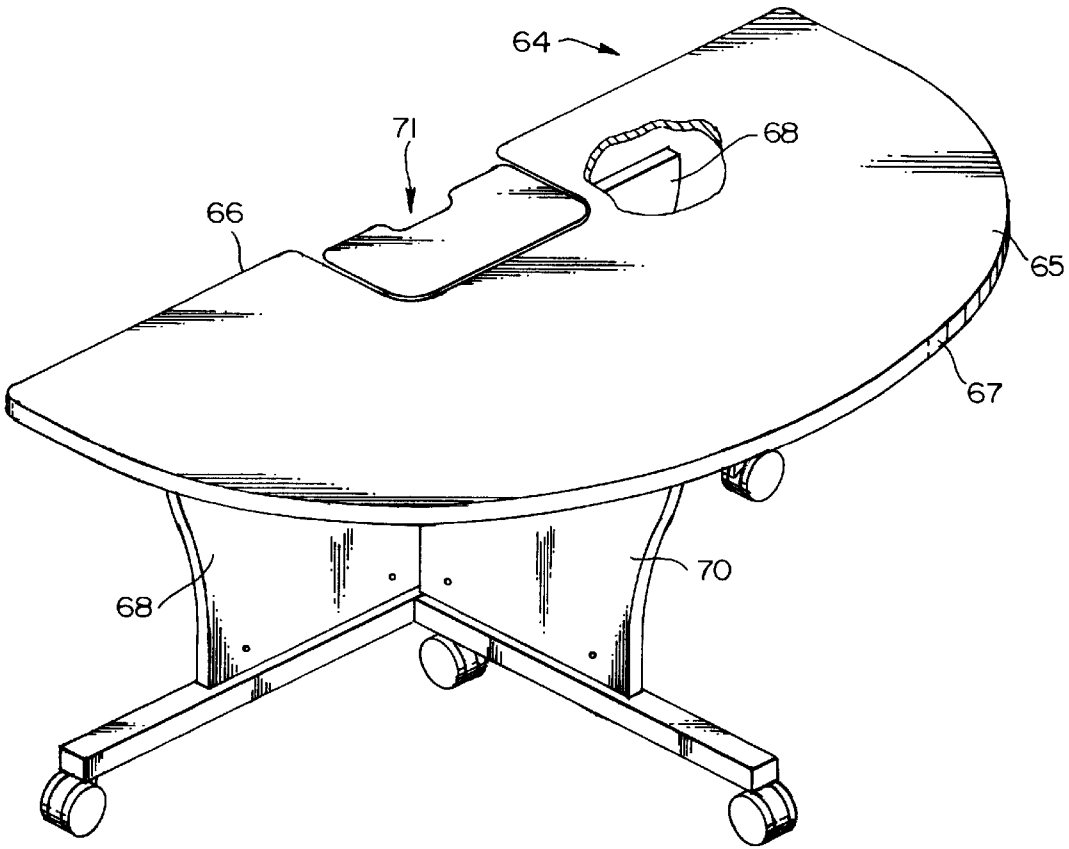
FIG. 4 is a perspective view of a fourth furniture unit of the present invention.

A fourth basic unit is shown at 64 in FIG. 4. The work surface 65 is a half-round (or oval). The half-round work surface 65 in the embodiment shown is 60" along straight edge 66, with curved edge 67 having a diameter of approximately 33". These dimensions can, of course, be varied. The half-round unit includes two end members 68 which are coplanar, and extend, respectively, outwardly from the center of straight edge 66. A third end member 70 extends from the mid-point of the straight edge 66 directly outwardly toward the curved edge 67. All three end members are supported on horizontal legs, and are similar to corresponding members on the other units. A rectangular raceway and cover 71, approximately 12" long, is located along straight edge 65, midlength thereof.

Figure 5:
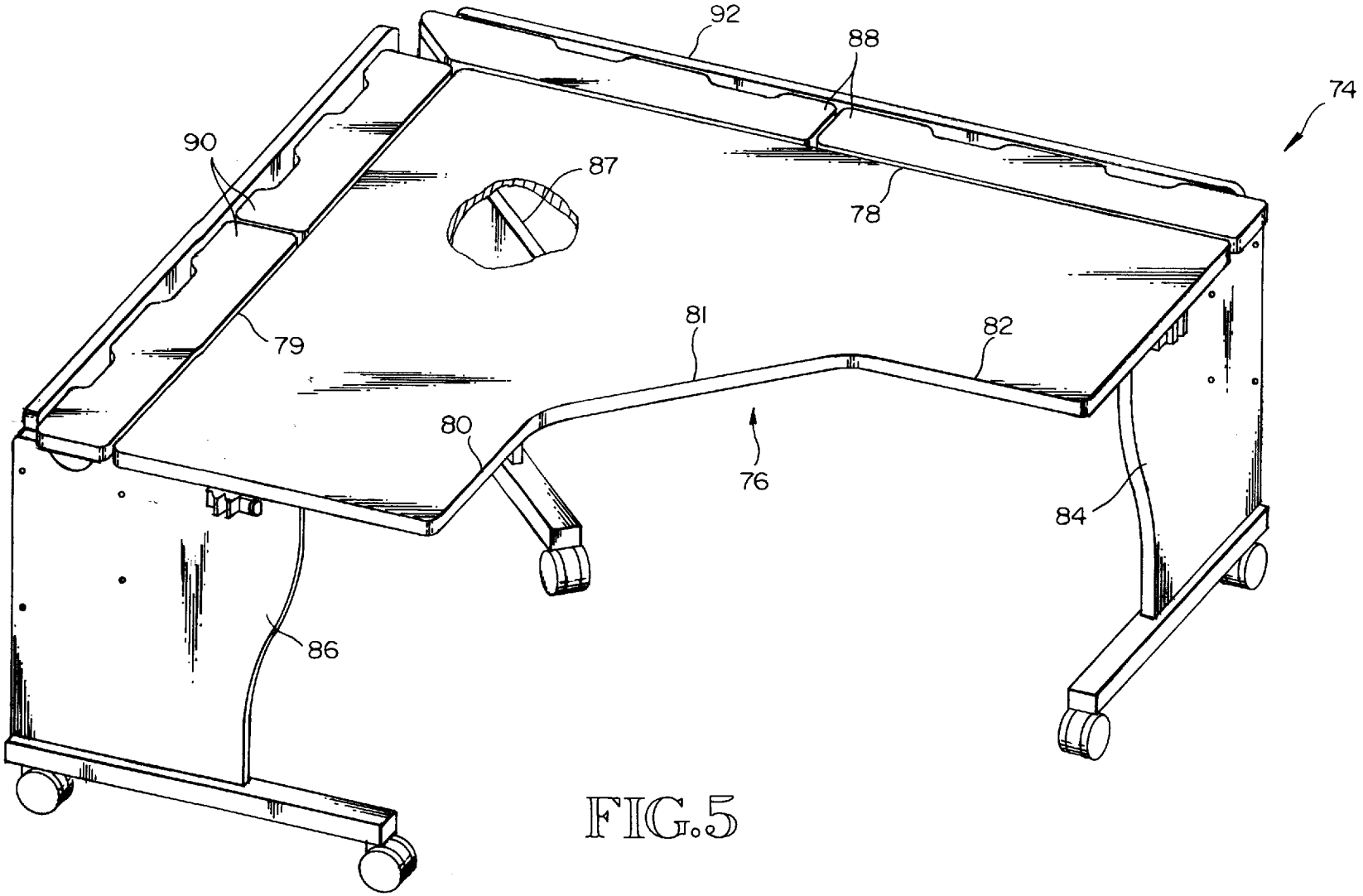
FIG. 5 is a perspective view of a fifth furniture unit of the present invention.

The fifth unit is an inside corner shown in FIG. 5, referred to generally at 74. The inside corner unit 74 is a 90° corner, with the user seated at an inside edge 76. The outside edges 78, 79 are straight, while the inside edge 76 has three generally straight portions 80–82, with intermediate portion 81 being at 45° relative to the other two portions, giving a generally curved effect. The inside corner unit includes two end members 84, 86 and a central end member 37, all similar to the end members for the other units. Each end member is supported by a horizontal leg. Along the rear, straight edges of the inside corner unit 76 are raceways 88 and 90, with their flip-up covers, two for each straight edge. The inside corner unit also includes two back members 92 and 94, which extend from the end members 84 and 86, respectively, to the center leg member 88.

Figure 2:
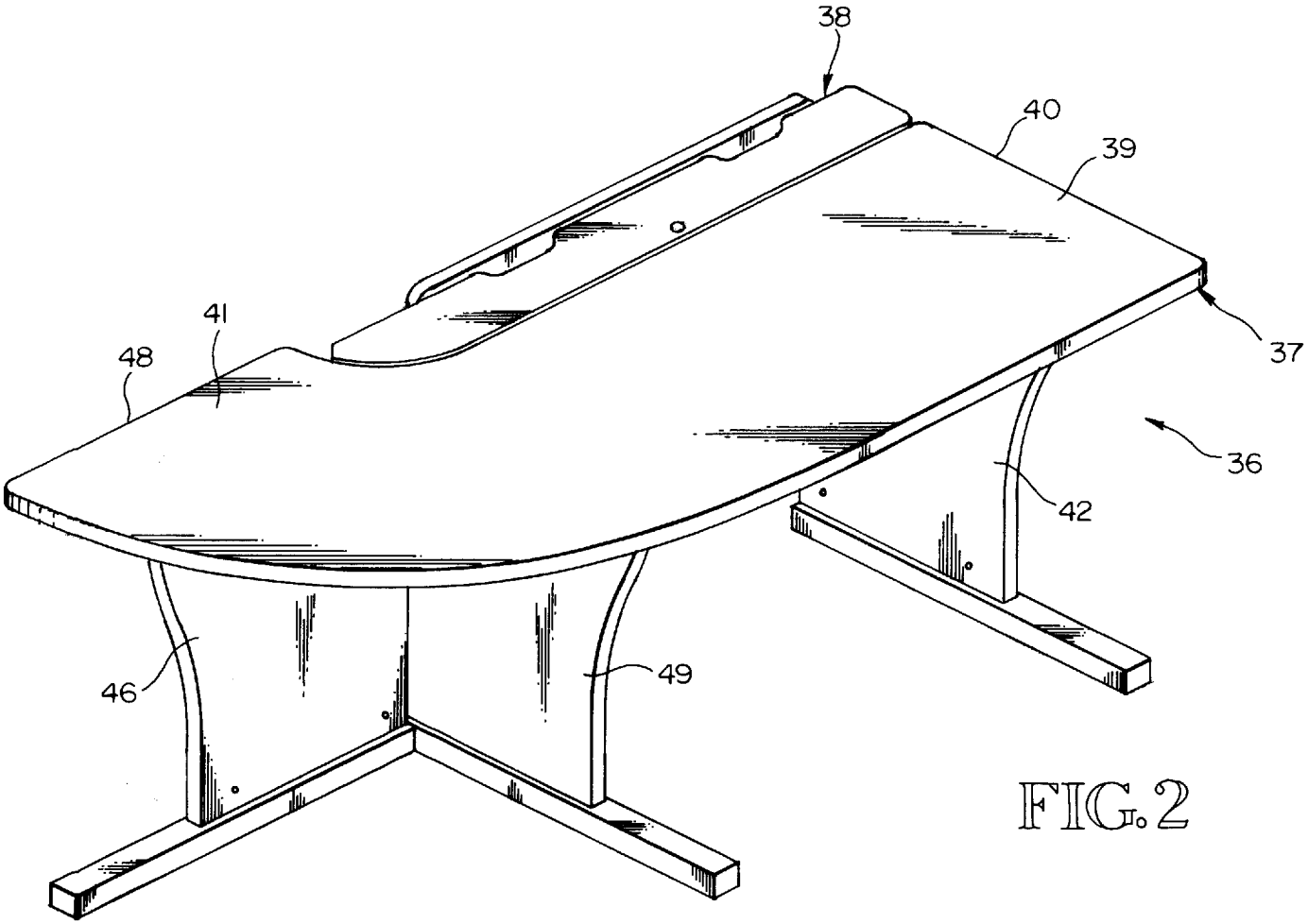
FIG. 2 is a perspective view of a second furniture unit of the present invention.
Figure 6:
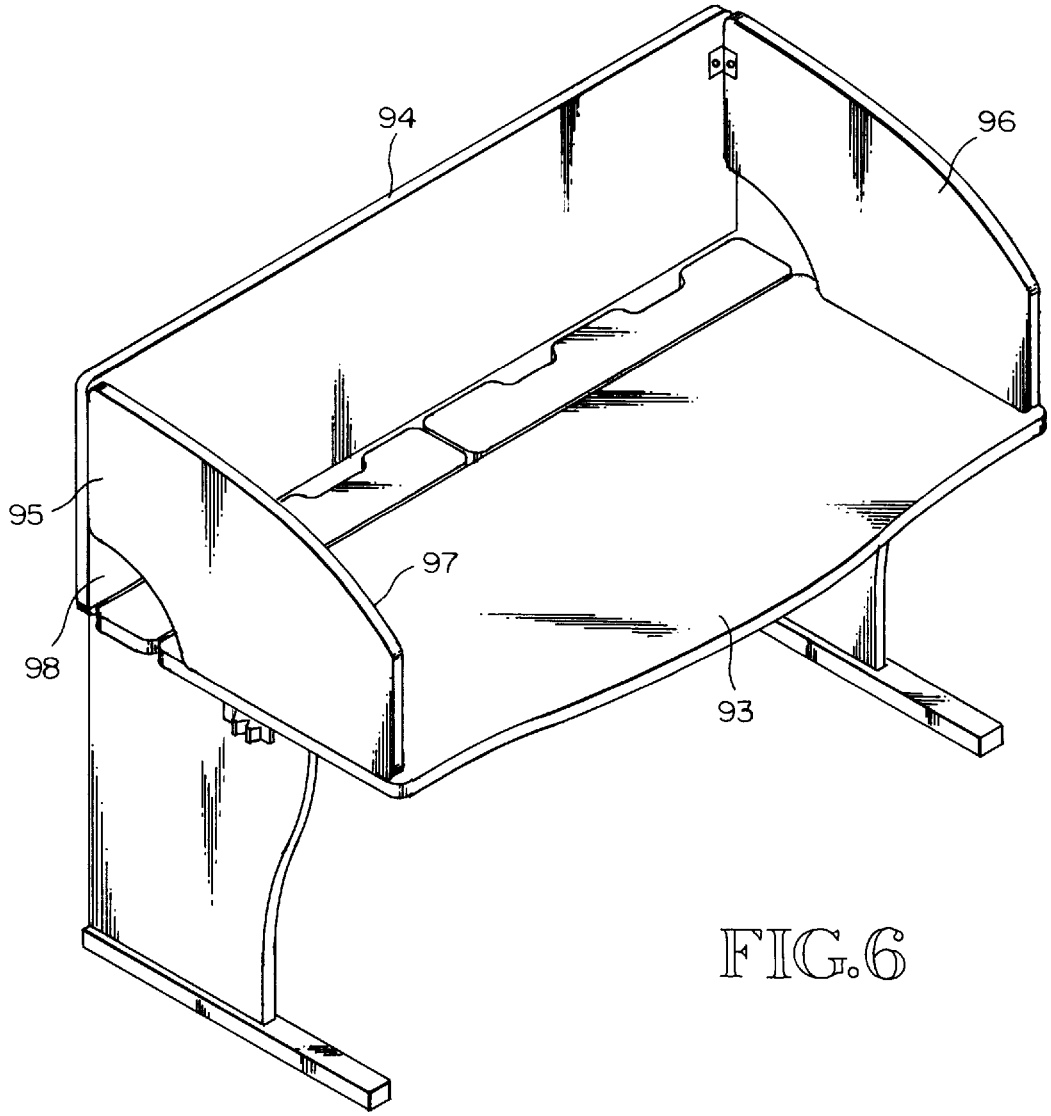
FIG. 6 is a perspective view of a modified version of the of FIG. 1, showing back and side panels thereon.
Figure 7:
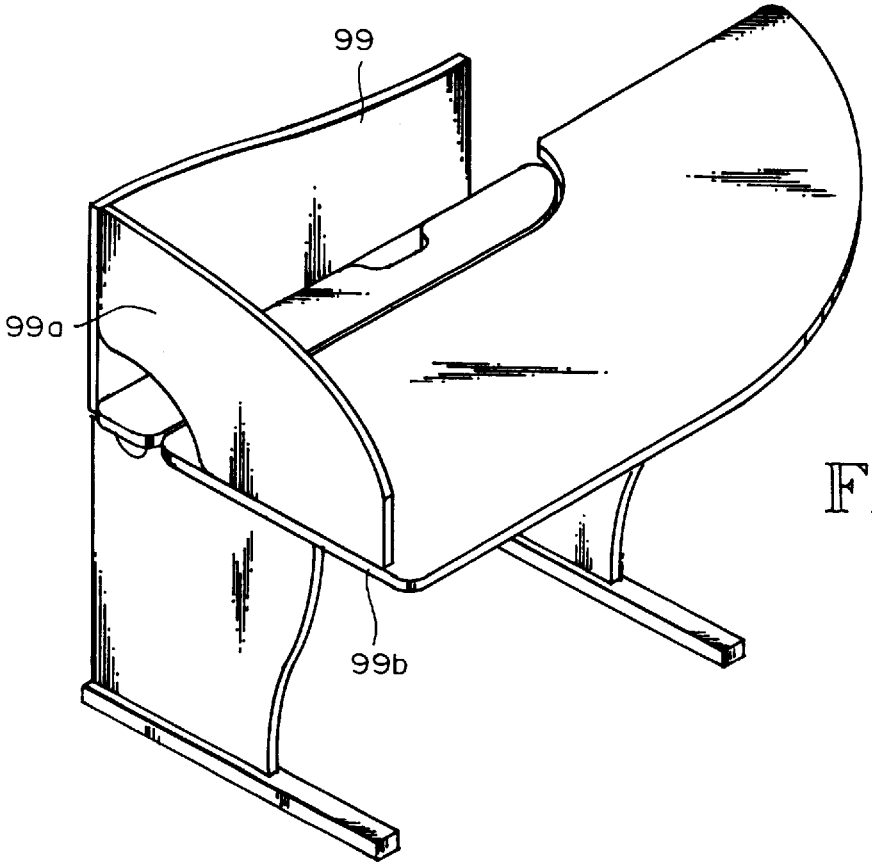
FIG. 7 is a perspective view of a modified version of the furniture unit of FIG. 2, showing back and side panels thereon.

FIGS. 6 and 7 show alternate embodiments of FIGS. 1 and 2, respectively. FIG. 6 includes an upper (above the work surface 93) back panel 94, which in the embodiment shown is approximately 18" high and extends the full length of the unit, while side panels 95 and 96 extend from the ends of the back panel 94 along the side edges of the work surface 93, terminating at the front edge of the work surface. The top edge 97 of the side panels curves slightly downwardly over the length of the panels, as shown. A cutout portion 98 is located at the inside corner of each side panel.

FIG. 7 includes an upper back panel 99 which extends for the straight portion of the unit and includes a curved or wave portion and a side panel 99*a*, curved similar to the side panels shown in FIG. 6, located along the square end edge 99*b* of the unit. In the embodiment shown, the upper back panel is 18" high at the end edge 99*b*, although the dimensions of the back and side panels could be varied.

Figure 10:
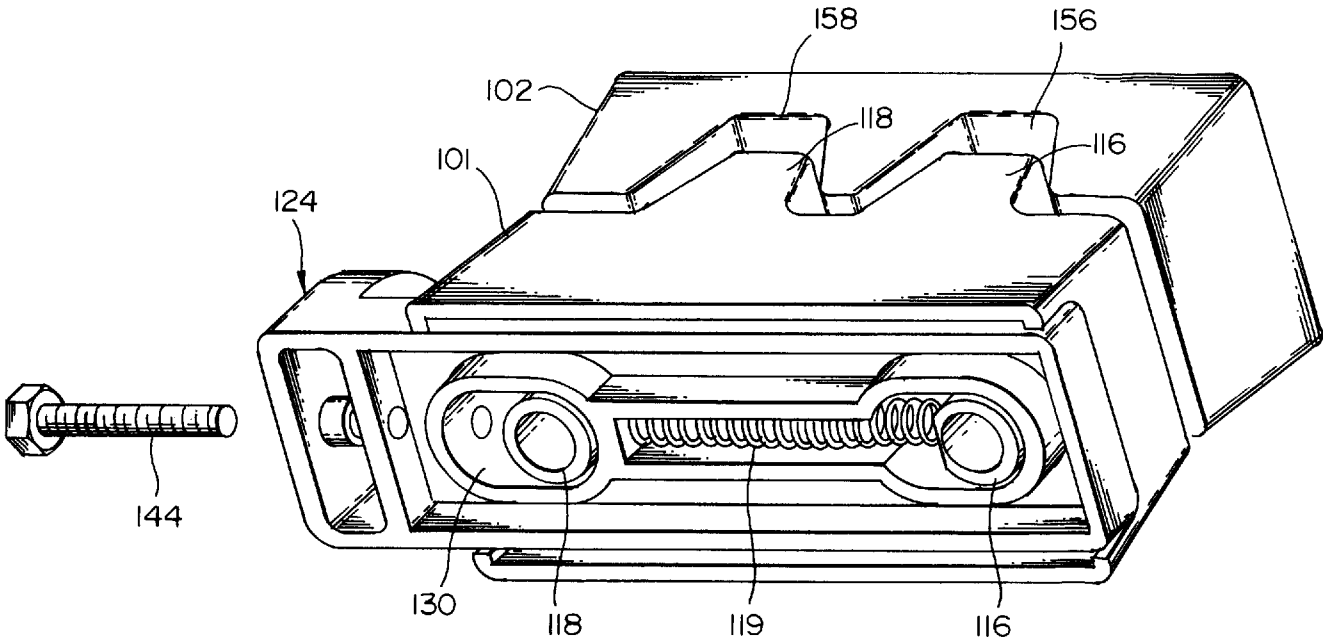
FIG. 10 is a schematic view of the underside of the latching portion of the connector of FIG. 8, showing the connector together.

FIGS. 8–10 show the easy connect/release connector 100 of the present invention, which connects the individual units described above together in various selected arrangements. The connector 100 includes a generally hollow latching portion 101 and a receiving portion 102. Each furniture unit described above includes a latching portion 101 on one end thereof and a receiving portion 102 on the other end thereof, secured to end members of the furniture units by bolts or the like. This arrangement permits any furniture unit described above to be secured to any other furniture unit. A multitude of combinations, clusters and arrangement, with various work surface configurations, is thus possible.

The latching portion 101 includes a body 104, which is generally 4 ¾" long by 2" wide at its base by 1½" high. The end surfaces 105, 106 and the longitudinal surfaces 107, 108 of body 104 taper slightly inwardly. Extending from top surface 114 of body 104 are two truncated triangular elements 116 and 118, which extend for the full width of the body and are approximately 1 ¼" wide at their base and approximately ½" at the upper end thereof. The two triangular elements 116 and 118 are separated by a space of approximately ¼" at their bases and begin approximately ⅝" in from each end of the body.

There is an opening 120 in slanted surface 122 of one of the triangular elements 116. Latching portion 101 also includes a sliding member 124. Sliding member 124 fits into an open slot at the bottom of latching portion 101. Sliding member 124 includes an elongated base section 126, which is approximately 5 ½" long, 1 ½" wide and approximately ½" high in the embodiment shown. Base section 126 has two oval openings 128 and 130 therethrough. The oval openings fit over two cylindrical posts 132 and 134 which are part of body 104 of latching portion 101, in the interior thereof. The free edges 135, 137 of the posts are basically coplanar with the lower edge of the latching portion. The oval openings 128 and 130 are sized and positioned to permit the sliding portion 124 to move transversely of the latching portion 101 approximately ⅜.

At one end of sliding portion 124 is a hemispherical portion 140 which in the embodiment shown extends approximately ⅞" above the upper surface 141 of base section 126. Also extending upwardly from the upper surface of base section 126, close to oval opening 128, is a hook member 142. Hook member 142 is approximately 1 ½" high and approximately ¾" square at its base. The upper portion 143 thereof is configured generally into the shape of a hook.

The hook member is located within the interior of triangular member 116 when the sliding member is in a retracted position, but extends through the opening 122 into the space between the two triangular elements when the sliding member is in its latched position. When the sliding member is in its latched position, the hook member extends through opening 122 and hooks onto a portion of receiving portion 102 of the connector, as explained below. In the latched position of the sliding member, the two portions of the connector are firmly secured together and cannot be readily separated. Release of the connector is accomplished by simply moving the sliding member in the opposite direction, so that the hook member retracts back with the interior of triangular member 116.

The sliding member further includes a spring 119 which extends between post 116 of latching portion 101 and an interior wall portion thereof defining oval opening 130. The spring 119 tends to bias the latching portion in its latched position. The sliding member can be locked into its latched position by means of a screw 144 which extends through a portion of the sliding member, bearing against one of the posts 118, preventing the sliding element from moving to release the latch.

Receiving portion 102 also comprises a generally hollow body 150, the body having similar dimensions to the body of latching portion 101 of the connector. However, receiving portion 102 includes two truncated triangular-shaped cutout sections 156 and 158 therein which extend for the full width of body 150. Cutouts 156 and 158 generally have the same configuration as the truncated triangular elements 116 and 118 of the latching portion, such that those truncated triangular elements 116, 118 can nest into the cutouts and so that the upper surface 114 of the latching portion abuts the upper surface 159 of the receiving portion. One of the truncated triangular cutouts includes an opening 160. This opening is arranged so that when the receiving portion and the latching portion are nested together and the sliding member of the receiving portion is in its latched position, the portion 143 of hook member 142 hooks around an edge of opening 160, locking the two elements securely together.

The sliding portion and receiving portion of the latch are both made of a high-impact, relatively stiff plastic. The walls of each portion are approximately ⅛" thick, and have a relatively smooth exterior surface. The plastic walls, upon application of a large pressure, such as might occur when a particular furniture unit is shifted somewhat while latched to an adjacent unit, will deform sufficiently that hook member 142 will disengage from receiving portion 102, thereby resulting in separation of the two latch elements. The latch thus comes apart prior to its otherwise being destroyed. This saves the connector from having to be periodically replaced.

The configuration of the two connector portions in combination with the spring bias of the sliding member results in a latching of the two portions simply by bringing one connector portion, i.e. the latching portion 101, into proper mating relationship with receiving portion 102. The particular design of the two portions allows for an initial misalignment or mismatch (in the horizontal plane) of the two portions. It is enough for the upper portions of the two triangular members of the latching portion to be initially positioned within the widest portion of the two cutout portions in the receiving portion.

As two units are brought closer together, the two portions of the connector more fully nest together, with a self-correcting alignment, so that by the time the two portions actually latch, the two portions are completely aligned and properly mated. The latch is also designed, in terms of the hook member and the configuration and size of the opening in the receiving portion hooked by the hook member, to permit a slight misalignment vertically, such as might occur due to uneven floors. From the latched position of FIG. 9, it is only necessary to move the sliding element inwardly (after the locking screw has been released) to move the lock member inwardly of the latching portion, releasing the two connector portions. The two adjacent furniture units on which the connector portions are located can then be conveniently separated and the units placed in other system configurations.

Hence, a system has been disclosed which comprises a plurality of several different computer furniture units. The units have at one end thereof a latching portion of a connector, while on the other end is a receiving portion of the connector. The units may be conveniently mated together into various configurations. Because of the particular construction, the units will separate under high pressure without destruction of the connector portions.

The connector itself is part of the present invention. The connector comprises two portions, which because of their particular configuration and arrangement, can be readily mated together. The configuration of the connector portions assists in aligning the two portions into proper position so that they can lock together. This includes a tolerance for a vertical mismatch. Also, while the embodiment shown includes truncated triangular elements and cutouts to produce the nesting effect, other shapes, including oval, circular and other tapered configurations, could be used.

Although a preferred embodiment of the invention has been disclosed herein for illustration, it should be understood that various changes, modifications and substitutions may be incorporated in such embodiment without departing from the spirit of the invention, which is defined by the claims as follows:

What is claimed is:

1. A system of computer furniture, comprising:

a plurality of curved furniture units, capable of stand-alone use, having two ends at 90° to each other and a corresponding curved work surface, wherein the curved work surface includes a raceway for electrical cords at a rear edge thereof, and wherein the units include a first latch member at one end of the unit and a second latch member at the other end thereof; and a plurality of linear furniture units, capable of stand-alone use, having a straight work surface with two ends, including a raceway for electrical cords at a rear edge thereof, wherein the linear units include a first latch member at one end of the unit, and a second latch member at the other end; wherein a first latch member on any of said curved and linear furniture units fits snugly into a second latch member on any other furniture unit to produce a fixed, latched connection therebetween and the furniture units on which they are located, and wherein the first and second latch members are located on the furniture units in such a manner that when furniture units are connected together, the raceways in the units line up with each other.

2. A system of claim 1, wherein the raceway on each furniture unit includes a small trough at the rear edge of the unit and a cover member which is rotatable and is coplanar with the work surface when the cover is in its non-rotated position, and wherein the furniture units each include side wall members having a cutout portion near an upper edge thereof coincident with the location of the raceway therein.

3. A system of claim 1, including a plurality of curved units which curve 90° in one direction and a plurality of curved units which curve 90° in an opposing direction.

4. A system of claim 1, wherein the curved units include in succession from one end thereof to the other an extended straight work surface portion and a curved work surface portion, thereby defining a conference-type furniture unit.

5. A system of claim 1, wherein the curved units are quarter-round furniture units having a work surface portion covering 90° and two straight edges, wherein one straight edge of the quarter-round unit is the same dimension as an abutting edge of an adjacent furniture unit to which it is connected and wherein at the apex of the quarter-round unit is a raceway for electrical cords.

6. A system of claim 1, including a plurality of half-round furniture units, capable of stand-alone use, having a work surface which is substantially hemispherical, having a curved edge and a straight edge, the straight edge being approximately twice as wide as an abutting edge of one adjacent unit.

7. A system of claim 1, including a plurality of inside corner furniture units, capable of stand-alone use, having first and second work surfaces which extend at 90° to each other, the inside corner units having two straight outer edges and a curved inner edge where a user is situated, the inside corner unit having raceways for electrical cords located along rear edges of the first and second work surfaces.

8. A system of claim 1, including leg elements for supporting the curved furniture units and the straight furniture units, the leg elements including casters to facilitate ease of movement of the furniture units.

9. A system of claim 1, wherein the latch members are so constructed and arranged of a deformable material that a large pressure placed on the latch members when they are latched together will result in the latch members deforming sufficiently where they are latched that they will come apart rather than break.

10. A latching system for connecting adjacent furniture units, comprising:

a first latch member positionable on one furniture unit, the first latch member including a body portion and two tapered, spaced elements which extend away from one surface of the body portion, the first latch member including a locking element which is movable between a retracted position and a latching position; and a second latch member positionable on an adjacent furniture, the second latch member including a body portion having two tapered slots therein which receivably mate with the tapered elements of the first latch member, so that when the first and second elements mate together, said one surface of the first latch member comes adjacent a corresponding surface of the second latch member, wherein the second latch member includes a cutout portion for receiving a hook portion of said locking element when the locking element is in its latching position, resulting in the two latch members and the one and adjacent furniture units being securely connected together.

11. An article of claim 10, wherein the tapered elements are truncated, triangular elements and the slots are matching truncated, triangular slots.

12. An article of claim 11, wherein the first and second latch members are hollow.

13. An article of claim 10, wherein the locking element includes a sliding base portion and wherein the hook portion extends upwardly from the sliding base portion into an interior portion of the first latch member and is recessed within the interior portion when the locking element is in its retracted position, but extends into a space between the two triangular elements when the locking element is in its latching position, and wherein the second latch member includes a wall which surrounds the cutout portion, to which the hook portion latches, preventing the first and second latch members from coming apart following latching thereof.

14. An article of claim 10, including a spring member for biasing the locking element into the latching position, such that movement of the locking element against the action of the spring member is required when release of the first and second latch members is desired.

15. An article of claim 10, including means for locking the first latch member in its latching position.

16. An article of claim 10, wherein the tapered configuration of the first and second latch members is such as to assist in guiding the first and second latch members into a mating relationship following initial positioning of the tapered elements of the first latch member in the tapered slots in the second latch member.

17. An article of claim 10, wherein the size and configuration of the cutout portion in the second latch member relative to the size and configuration of the hook portion of the locking element are such as to permit the latch members to latch together even with a mismatch in vertical position of the two latch members.

18. An article of claim 10, wherein the first and second latch members are so configured and arranged and have such a wall thickness that the first and second latch members separate from each other under significant pressure, rather than breaking.

* * * * *